US008656947B1

(12) United States Patent
Barton

(10) Patent No.: US 8,656,947 B1
(45) Date of Patent: Feb. 25, 2014

(54) SELF-EVACUATING VERTICAL DOWNSPOUT ADAPTER

(76) Inventor: Lewis Barton, Mooresville, NC (US)

( * ) Notice: Subject to any disclaimer, the term of this patent is extended or adjusted under 35 U.S.C. 154(b) by 373 days.

(21) Appl. No.: 12/930,872

(22) Filed: Jan. 19, 2011

Related U.S. Application Data

(60) Provisional application No. 61/336,211, filed on Jan. 19, 2010.

(51) Int. Cl.

| | |
|---|---|
| ***E04D 13/08*** | (2006.01) |
| ***B01D 35/16*** | (2006.01) |
| ***B01D 29/94*** | (2006.01) |
| ***B01D 29/92*** | (2006.01) |

(52) U.S. Cl.
USPC ..... 137/544; 52/16; 210/162; 210/170.03; 210/433.1; 210/459

(58) Field of Classification Search
CPC . E04D 13/08; E04D 13/645; E04D 2013/086; E04D 2013/0866; B01D 35/02
USPC ..... 137/357, 544; 52/16; 210/130, 162, 210/170.03, 433.1, 446, 459, 747.3
See application file for complete search history.

(56) References Cited

U.S. PATENT DOCUMENTS

| | | | | | |
|---|---|---|---|---|---|
| 94,271 | A * | 8/1869 | Ayres | 137/873 |
| 1,188,280 | A * | 6/1916 | Kuenzli | 210/433.1 |
| 1,552,902 | A * | 9/1925 | Werner | 210/130 |
| 1,653,473 | A * | 12/1927 | Schulz | 210/130 |
| 2,494,780 | A * | 1/1950 | Schmidt | 210/357 |
| 4,801,377 | A * | 1/1989 | Bolt | 210/162 |
| 5,709,051 | A * | 1/1998 | Mazziotti | 52/12 |
| 6,263,618 | B1 * | 7/2001 | Jones | 52/12 |
| 6,705,049 | B2 * | 3/2004 | Esmond et al. | 52/16 |
| 2008/0086953 | A1 * | 4/2008 | Graf | 52/12 |
| 2008/0229673 | A1 * | 9/2008 | LaMorte et al. | 52/12 |

* cited by examiner

*Primary Examiner* — John K Fristoe, Jr.
*Assistant Examiner* — Frederick D Soski
(74) *Attorney, Agent, or Firm* — Schwartz Law Firm, P.C.

(57) ABSTRACT

A self-evacuating vertical downspout adapter includes an elongated adapter body defining open top and bottom ends, and an enlarged-volume debris trap with a debris outlet between the top and bottom ends. A drainage grate is located inside the adapter body and defines a drain-through floor of the debris trap angled downwardly towards the debris outlet. A hinged outlet door is attached to the adapter body adjacent the debris outlet, and is urged in a normally closed position to prevent substantial escape of rainwater through the debris outlet. The outlet door is adapted for being pivoted on-demand to a temporarily open position by debris captured on the drainage grate and gravity-fed towards the debris outlet for automatic evacuation.

15 Claims, 6 Drawing Sheets

SELF-EVACUATING VERTICAL DOWNSPOUT ADAPTER

TECHNICAL FIELD AND BACKGROUND OF THE INVENTION

This invention relates generally to a self-evacuating vertical downspout adapter and method. In exemplary embodiments described herein, the present downspout adapter is designed to provide a low-maintenance, effective, durable and aesthetic structural transition from typically square or rectangular-section downspout piping to typically round-section horizontal underground piping in rainwater distribution systems.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a self-evacuating vertical downspout adapter designed for operatively transitioning from a typically square or rectangular rainwater downspout to a typically round horizontal underground or above ground rainwater distribution system. The downspout adapter comprises an elongated adapter body defining open first and second ends, and a debris outlet formed between the ends. A drainage grate is located inside the adapter body, and is angled downwardly at the debris outlet. A hinged outlet door is attached to the adapter body adjacent the debris outlet, and is urged in a normally closed position to prevent substantial escape of rainwater through the debris outlet. The outlet door is adapted for being pivoted on-demand to a temporarily open position by debris captured on the drainage grate and gravity-fed towards the debris outlet for automatic evacuation.

The exemplary drainage grate may comprise any regularly or variably spaced collection of essentially identical, parallel, elongated elements; or alternatively, the drainage grate may comprise two perpendicular sets of spaced elements in a mesh construction; or alternatively, the drainage grate may comprise any other open construction sufficient to substantially capture relatively large debris while enabling substantial passage of rainwater.

According to another exemplary embodiment, the outlet door is counterweighted for biasing the door against the adapter body in the normally closed position.

According to another exemplary embodiment, an interior (continuous solid wall) arcuate sweep is located downstream of the drainage grate, and is adapted for directing a flow of rainwater outwardly through the second end of the adapter body.

According to another exemplary embodiment, an enlarged downspout connection collar is located at the first end of the adapter body.

According to another exemplary embodiment, a transition boot is located at the second end of the adapter body. A transition coupling may attached to the boot to operatively connect the downspout adapter to any type of (underground or above ground) collection piping.

According to another exemplary embodiment, the outlet door comprises a (continuous) solid front and opposing wrap-around wings.

According to another exemplary embodiment, the wings of the outlet door define respective weight-distributing cutouts.

According to another exemplary embodiment, the hinged outlet door is attached to the adapter body at a counter-weighted pivot point adjacent a top end of the outlet door. A substantial portion of the weight of the outlet door in the closed position is located rearward of the pivot point.

According to another exemplary embodiment, the adapter body comprises a rigid stainless steel construction.

In another exemplary embodiment, the disclosure comprises a self-evacuating vertical downspout adapter including an elongated adapter body defining open top and bottom ends, and an enlarged-volume debris trap with a debris outlet between the top and bottom ends. A drainage grate is located inside the adapter body and defines a drain-through floor of the debris trap angled downwardly towards the debris outlet. A hinged outlet door is attached to the adapter body adjacent the debris outlet, and is urged in a normally closed position to prevent substantial escape of rainwater through the debris outlet. The outlet door is adapted for being pivoted on-demand to a temporarily open position by debris captured on the drainage grate and gravity-fed towards the debris outlet for automatic evacuation.

According to another exemplary embodiment, the debris trap comprises outward-projecting top, bottom, and side (continuous solid wall) extensions formed with the adapter body.

According to another exemplary embodiment, the outward-projecting top and bottom extensions of the debris trap are angled inwardly towards the debris outlet.

According to another exemplary embodiment, the angled drainage grate is disposed substantially parallel to the angled top extension of the debris trap.

In yet another exemplary embodiment, the disclosure comprises a method for automatically evacuating a vertical downspout adapter. The method comprises gravity-feeding debris captured on a downwardly angled drainage grate towards a debris outlet of the downspout adapter. A hinged outlet door moves on-demand from a normally closed position covering the debris outlet to a temporarily open position, such that debris captured on the drainage grate and gravity-fed towards the outlet causes the outlet door to pivot outwardly from the closed position to the open position for automatic evacuation.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
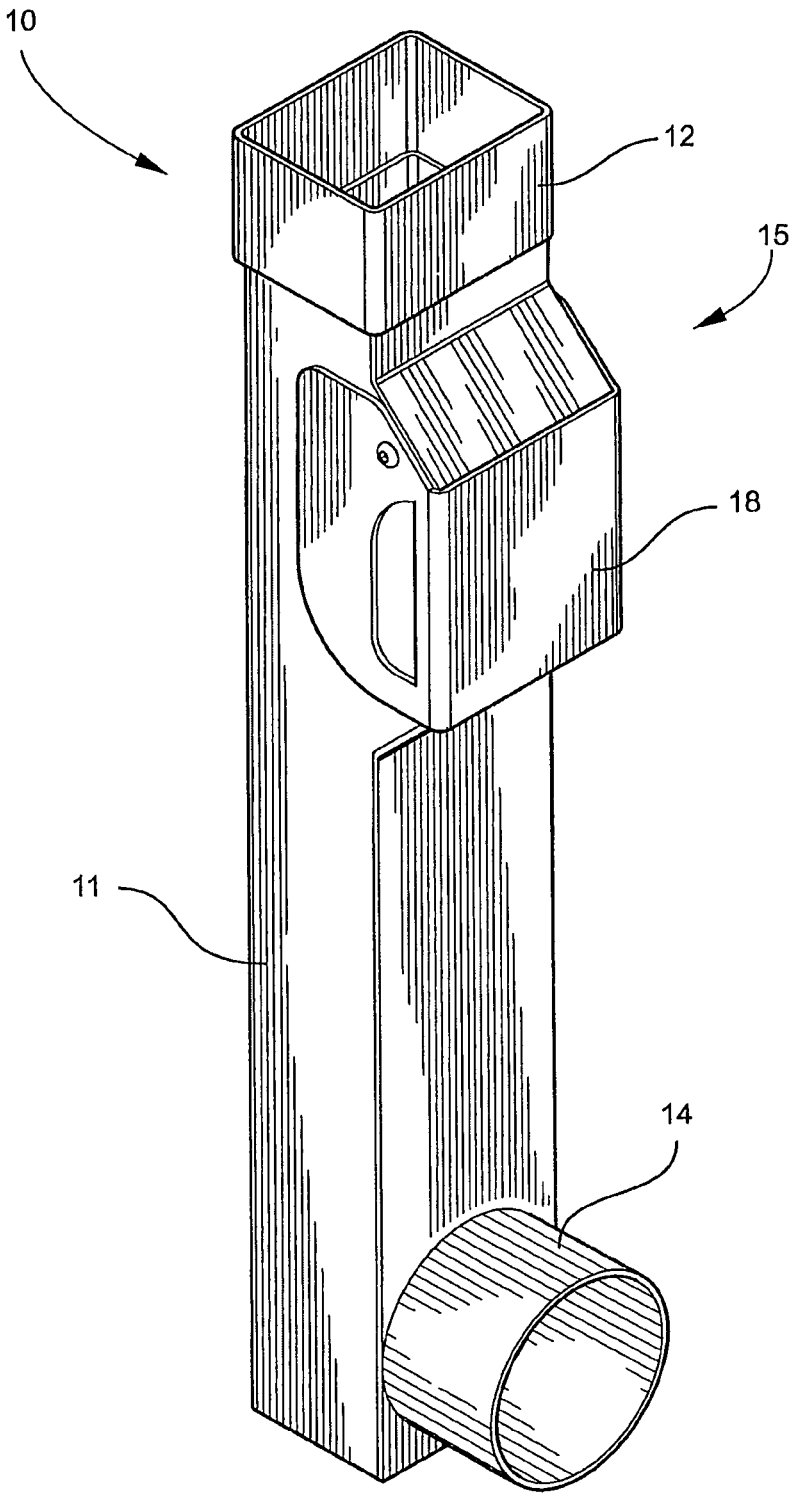
FIG. 1 is a perspective view of a self-evacuating vertical downspout adapter according to one exemplary embodiment of the present disclosure.
Figure 2:
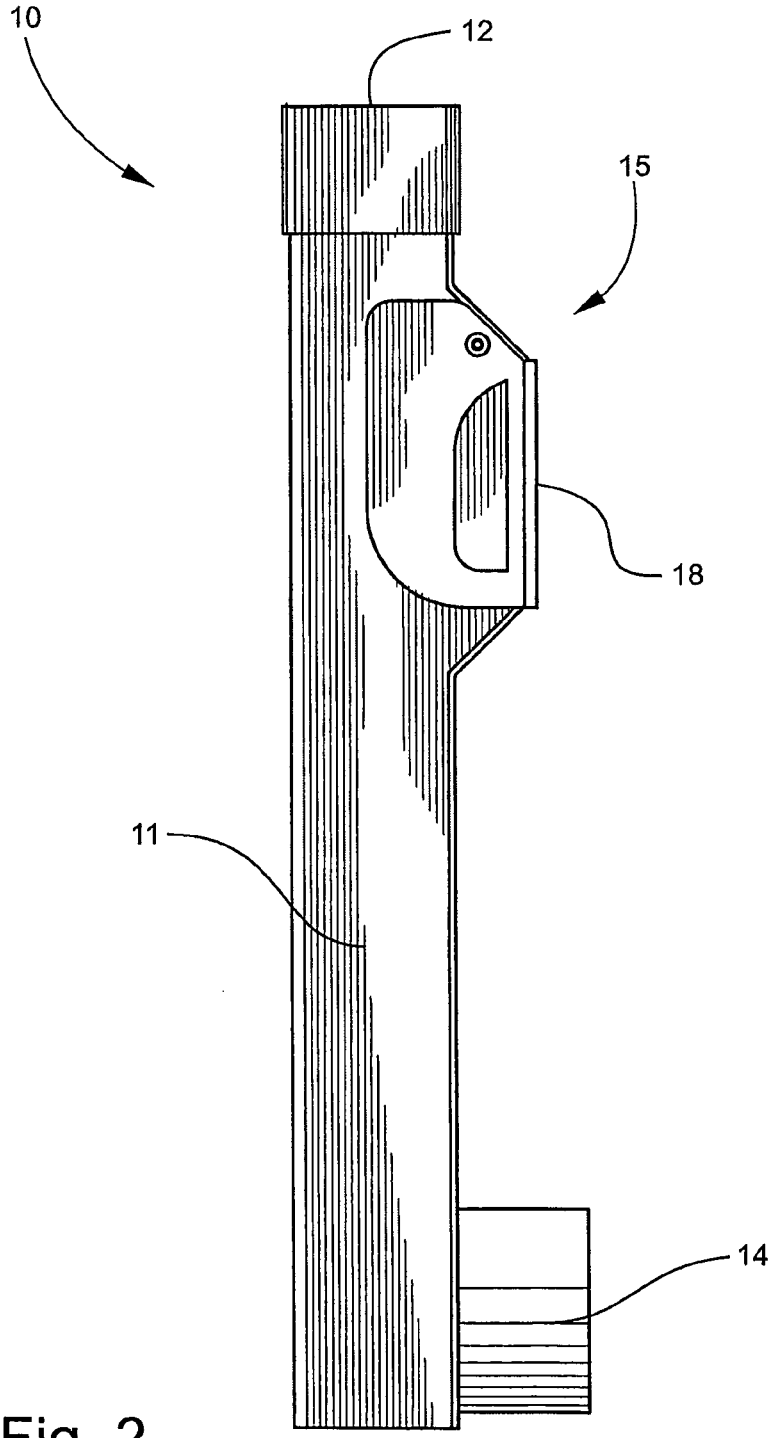
FIG. 2 is a side view of the exemplary downspout adapter.

Referring now specifically to the drawings, a self-evacuating vertical downspout adapter according to one exemplary embodiment of the present disclosure is illustrated in FIGS. 1 and 2, and shown generally at reference numeral 10. The exemplary downspout adapter 10 is anchored to an exterior wall of a building, and designed to provide a structural transition from typically square or rectangular vertical downspout piping to typically round PVC, HDPE, or metal horizontal underground piping in rainwater management, distribution, and/or collection systems. The exemplary downspout adapter 10 comprises an elongated stainless steel body 11 defined by joined solid walls, a square-section downspout connection collar 12 located at an open top end of the adapter body 11, and a round-section 90-degree transition boot 14 located at an open bottom end of the adapter body 11. The connection collar 12 attaches the downspout adapter to an existing downspout (or downpipe) designed for carrying rainwater from a rain gutter attached to a building rooftop to ground level. The transition boot 14 cooperates with a round-section (e.g., PVC) coupling to interconnect the downspout adapter 10 to underground piping where the water is directed away from the building's foundation and to a sewer, or for rainwater harvesting, or let into the ground through seepage. The connection collar 12 and transition boot 14 may be permanently attached to the adapter body 11 by welding or other suitable means.

Figure 3:
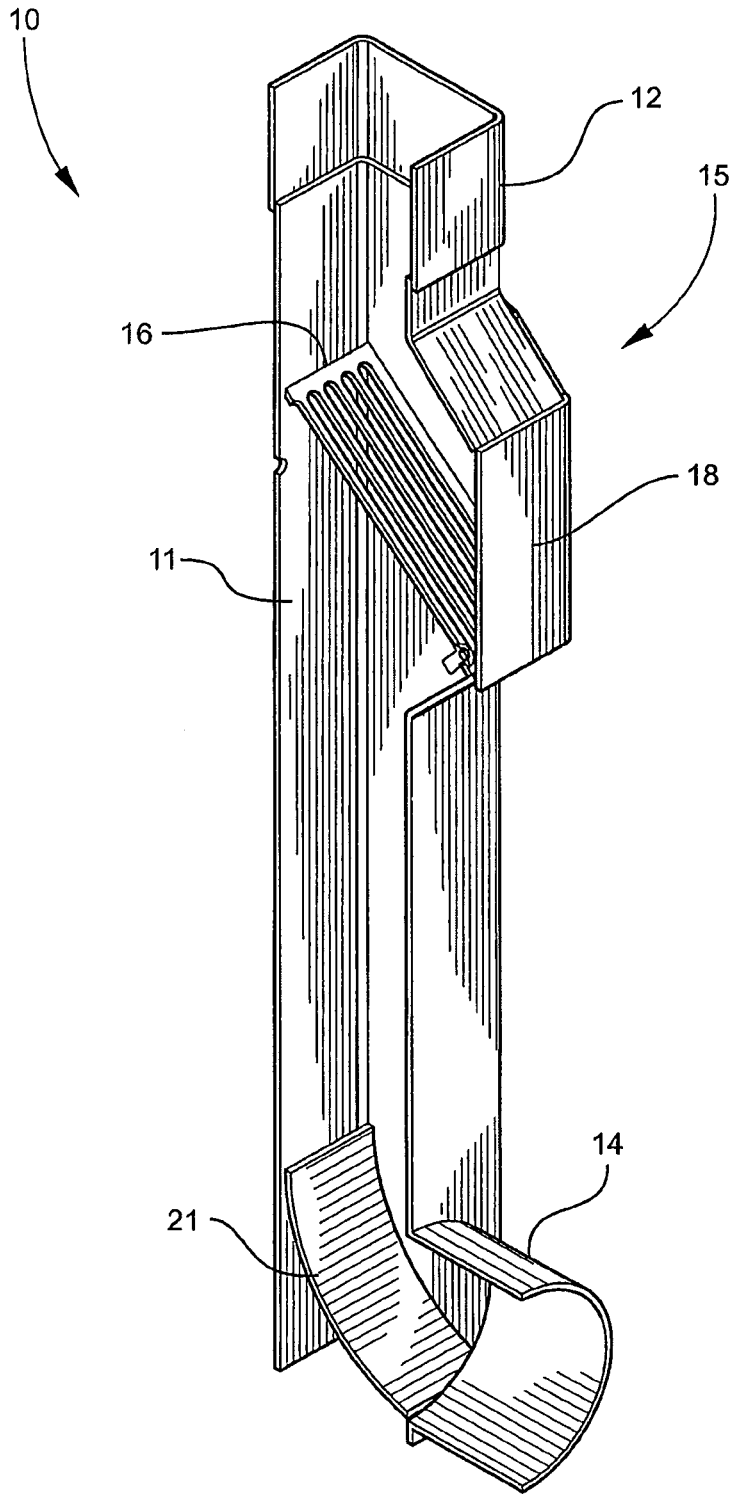
FIG. 3 is a longitudinal cross-section of the exemplary downspout adapter.
Figure 4:
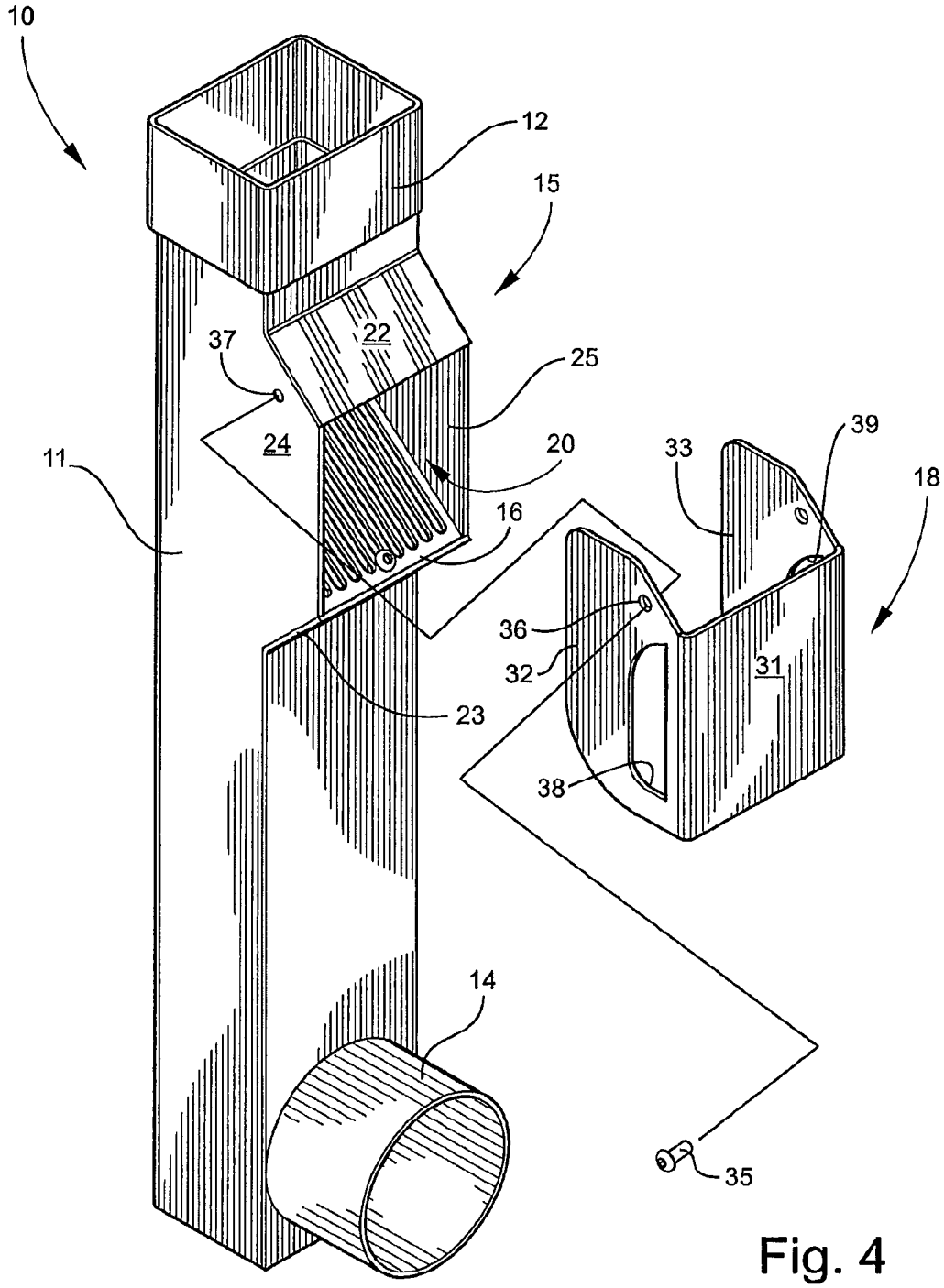
FIG. 4 is a perspective view of the exemplary downspout adapter with the hinged outlet door removed.
Figure 5:
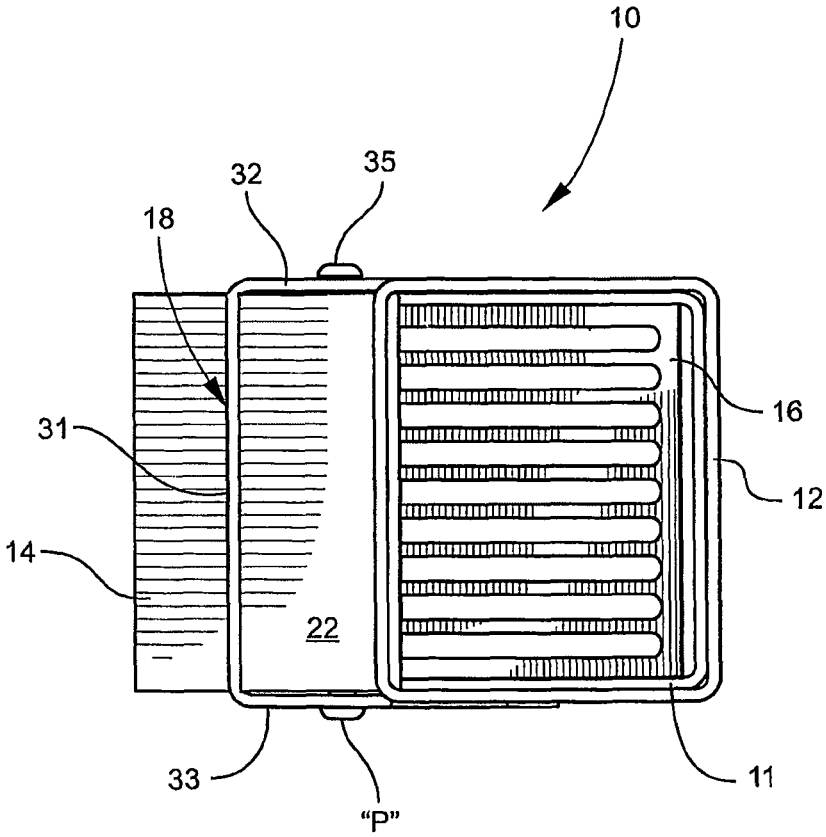
FIG. 5 is a top end view of the exemplary downspout adapter.

Referring to FIGS. 3, 4, and 5, an enlarged-volume debris trap 15 is located between top and bottom ends of the adapter body 11, and cooperates with an internal stainless steel drainage grate 16 and hinged outlet door 18 to control the passage of debris and rainwater through the adapter 10 and into the attached underground piping. The drainage grate 16 forms a drain-through floor of the debris trap 15, and is angled downwardly from a back wall of the adapter body 11 to the bottom edge of an opposing debris outlet 20. The hinged outlet door 18 is attached to the adapter body 11, as described below, and is urged (or biased) in a normally closed position to prevent substantial escape of rainwater through the debris outlet 20. Rainwater entering the adapter 10 and passing through the grate 16 is carried outwardly by an arcuate (solid wall) sweep 21 through the open bottom end of the adapter body 11 and transition boot 14. The remainder of the debris trap 15 is defined by outward-projecting top and bottom extensions 22, 23 integrally-formed with a front wall of the adapter body 11, and side extensions 24, integrally-formed with respective side walls of the adapter body 11. In the exemplary embodiment, the top and bottom extensions 22, 23 are angled inwardly (converging) towards the debris outlet 20, and the downwardly angled drainage grate 16 is disposed substantially parallel to the top extension 22.

As best shown in FIG. 4, the hinged stainless steel outlet door 18 comprises a solid front 31 and opposing wrap-around wings 32, 33. The wings 32, 33 of the outlet door 18 are attached by respective pins 35 extending through aligned holes 36, 37 at a pivot point "P" (FIG. 6) adjacent a top edge of the debris outlet 20. As indicated above, the outlet door 18 is biased in the normally closed position shown in FIGS. 1 and 2. While an operative closing force may be achieved in a variety of ways (e.g., springs, elastic straps, or the like), the present wings 32, 33 define respective weight-distributing cutouts 38, 39 such that a substantial mass (or weight) of the outlet door 18 when closed is provided in the wings 32, 33 rearward of the pivot point "P".

Figure 6:
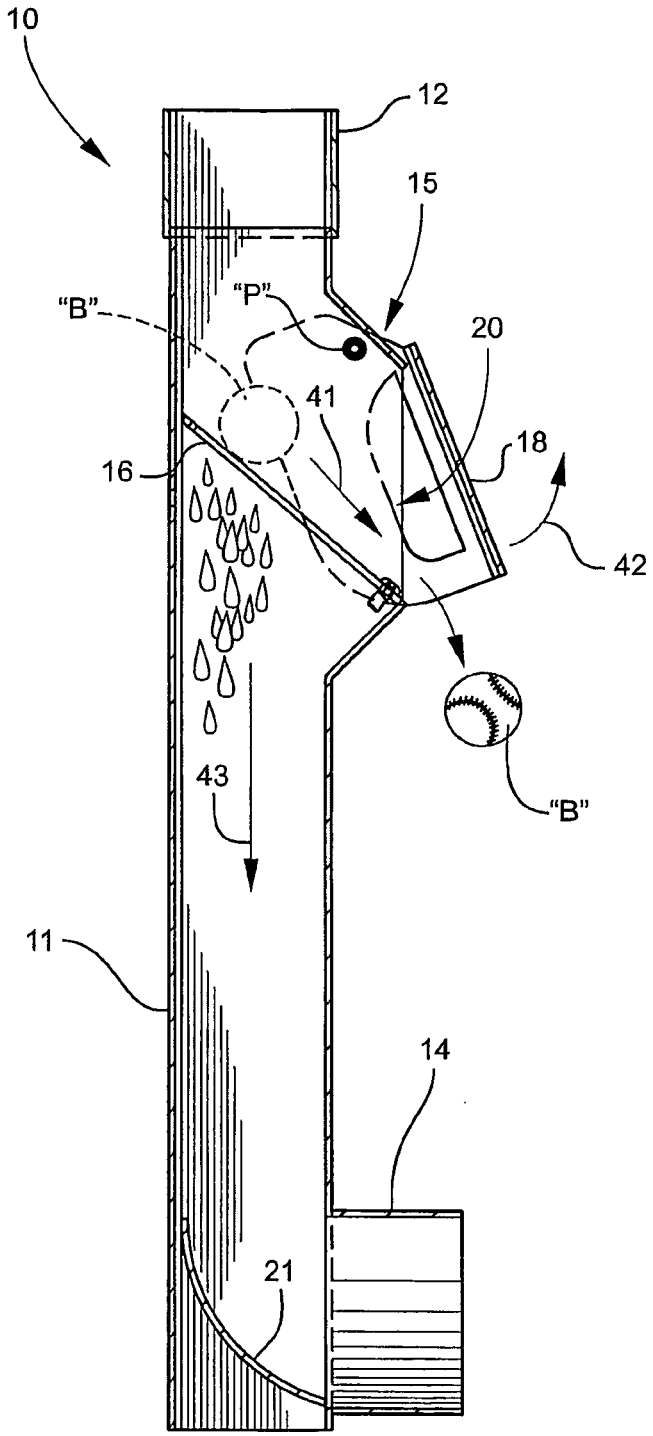
FIG. 6 is side cross-section of the exemplary downspout adapter demonstrating the automatic evacuation of debris from the integral debris trap.

Referring to FIG. 6, any solid debris, such as ball "B", entering the downspout adapter 10 and captured on the drainage grate 16 is gravity-fed downwardly towards the outlet 20 of the debris trap 15, as indicated by direction arrow 41. A threshold weight of debris "B" collecting in the debris trap 15 and bearing against the outlet door 18 causes the outlet door 18 to temporarily pivot on-demand to an open position, indicated by arrow 42, thereby evacuating the debris "B" from the adapter 10; during which rainwater continues to pass (simultaneously) through the drainage grate 16, as indicated by arrow 43, towards the bottom end of the adapter body 11. Once the debris "B" is evacuated, the outlet door immediately and automatically returns to its normally closed position. Other examples of debris often passed through a vertical downspout include leaves, sticks, nuts, rocks, and the like.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A self-evacuating vertical downspout adapter, comprising:
   - an elongated adapter body defining open first and second ends, and a debris outlet formed between said ends;
   - a drainage grate located inside said adapter body and angled downwardly at said debris outlet; and
   - a hinged outlet door attached to said adapter body adjacent said debris outlet, and urged in a normally closed position to prevent substantial escape of rainwater through said debris outlet, and adapted for being pivoted on-demand to a temporarily open position by debris captured on said drainage grate and gravity-fed towards said debris outlet for automatic evacuation, said hinged outlet door comprising a solid front and opposing wrap-around wings, and said wings defining respective weight-distributing cutouts.

2. A self-evacuating vertical downspout adapter according to claim 1, wherein said outlet door is weighted for biasing said door against said adapter body in the normally closed position.

3. A self-evacuating vertical downspout adapter according to claim 1, and comprising an interior arcuate sweep located downstream of said drainage grate, and adapted for directing a flow of rainwater outwardly through the second end of said adapter body.

4. A self-evacuating vertical downspout adapter according to claim 1, and comprising an enlarged downspout connection collar located at the first end of said adapter body.

5. A self-evacuating vertical downspout adapter according to claim 1, and comprising a transition boot located at the second end of said adapter body.

6. A self-evacuating vertical downspout adapter according to claim 1, wherein said hinged outlet door is attached to said adapter body at a counterweighted pivot point adjacent a top end of said outlet door.

7. A self-evacuating vertical downspout adapter according to claim 1, wherein said adapter body comprises a rigid stainless steel construction.

8. A self-evacuating vertical downspout adapter, comprising:
   - an elongated adapter body defining open top and bottom ends, and an enlarged-volume debris trap with a debris outlet between said top and bottom ends;
   - a drainage grate located inside said adapter body and defining a drain-through floor of said debris trap angled downwardly towards said debris outlet; and
   - a hinged outlet door attached to said adapter body adjacent said debris outlet, and urged in a normally closed position to prevent substantial escape of rainwater through said debris outlet, and adapted for being pivoted on-demand to a temporarily open position by debris captured on said drainage grate and gravity-fed towards said debris outlet for automatic evacuation, said hinged outlet door comprising a solid front and opposing wrap-around wings, and said wings defining respective weight-distributing cutouts.

9. A self-evacuating vertical downspout adapter according to claim 8, wherein said debris trap comprises outward-projecting top, bottom, and side extensions formed with said adapter body.

10. A self-evacuating vertical downspout adapter according to claim 9, wherein the outward-projecting top and bottom extensions of said debris trap are angled inwardly towards said debris outlet.

11. A self-evacuating vertical downspout adapter according to claim 10, wherein said angled drainage grate is disposed substantially parallel to the angled top extension of said debris trap.

12. A self-evacuating vertical downspout adapter according to claim 8, wherein the wings of said outlet door are attached to respective side extensions of said debris trap at a counterweighted pivot point.

13. A self-evacuating vertical downspout adapter according to claim 8, and comprising an interior arcuate sweep located downstream of said drainage grate, and adapted for directing a flow of rainwater outwardly through the bottom end of said adapter body.

14. A self-evacuating vertical downspout adapter according to claim 8, and comprising an enlarged downspout connection collar located at the top end of said adapter body.

15. A self-evacuating vertical downspout adapter according to claim 8, and comprising a transition boot located at the bottom end of said adapter body.

* * * * *